United States Patent [19]

Hall et al.

[11] 4,158,411

[45] Jun. 19, 1979

[54] DISPENSING PACKAGE

[76] Inventors: Douglas C. Hall, 619 Arcade, Gladwin, Mich. 48624; Charles R. Schroeder, 30141 Wicklow, Farmington Hills, Mich. 48024

[21] Appl. No.: 855,109

[22] Filed: Nov. 25, 1977

Related U.S. Application Data

[63] Continuation of Ser. No. 684,524, May 10, 1976, abandoned.

[51] Int. Cl.[2] ..... B65D 83/04; B65D 85/56

[52] U.S. Cl. ..... 206/531; 206/539

[58] Field of Search ..... 206/488, 498, 489, 484, 206/471, 469, 459, 445, 530, 531, 532, 534, 534.1, 538, 539, 613, 614, 629, 631, 634; 229/3.5 MF

[56] References Cited

U.S. PATENT DOCUMENTS

| | | | |
|---|---|---|---|
| 2,317,860 | 4/1943 | Sorenson | 206/531 |
| 2,415,859 | 2/1947 | Ancker | 206/539 |
| 3,283,885 | 11/1966 | Grunewald et al. | 206/531 |
| 3,397,671 | 8/1968 | Hartman, Jr. et al. | 206/532 |
| 3,809,221 | 5/1974 | Compere | 206/531 |
| 3,894,896 | 7/1975 | Watanabe | 156/69 |
| 3,899,080 | 8/1975 | Brunda | 206/531 |
| 3,921,805 | 11/1975 | Compere | 206/532 |
| 3,924,747 | 12/1975 | Gerner | 206/531 |

*Primary Examiner*—Davis T. Moorhead

*Attorney, Agent, or Firm*—Reising, Ethington, Barnard, Perry & Brooks

[57] ABSTRACT

A dispensing package for containing a plurality of individual dosages of pills, capsules, tablets and the like that can be selectively removed one dose at a time. A cover portion for the package is made up of an outer layer of paperboard or the like with an inner layer of rupturable metal foil or the like bonded to one surface. Disc-shaped punch-out lids are cut into the paperboard layer and are held in position by the foil. A container portion is bonded to the foil and includes a sheet of flexible plastic material formed with a plurality of pockets or blisters. One of the lids overlies each of the pockets and a single dose of pills or the like is contained in each of the pockets. The paperboard layer has high strength and stiffness relative to the foil. Consequently, by collapsing one of the pockets against the cover portion, the portion of the foil attached to the associated lid ruptures and separates from the cover portion with the lid so that the pill is pressed through the opening uncovered by the lid.

2 Claims, 6 Drawing Figures

DISPENSING PACKAGE

This is a continuation of application Ser. No. 684,524, filed May 10, 1976, now abandoned.

BACKGROUND OF THE INVENTION

1. Field of the Invention

This invention relates generally to medicinal packages, and is particularly concerned with dispensing packages that contain a plurality of individual doses of medicine in the form of pills or capsules so that the individual doses can be easily removed from the package one at a time. The invention is also concerned with such packages which include a reminder system for assisting in accounting for the doses taken, particularly when the patient must take regular doses over a long period of time.

2. Description of the Prior Art

The packaging and dispensing of medicine for patients who must take regular doses over a long period of time poses particular problems for pharmacists or other packagers of the medicine, as well as for medical personnel in hospitals and nursing homes responsible for supplying medicine to individual patients, and to the patient who takes the medicine unsupervised.

Usually, the prescriptions are filled to be taken over a specific number of days, with the doses per day varying from patient to patient. Many medicines, even in the form of pills, tablets or capsules, deteriorate when subjected to high humidity or moisture. Obviously, it is desirable and necessary that each daily dose be isolated in a sanitary compartment.

It is necessary, particularly for unsupervised elderly patients, that the doses be easily removable from the package. It is also particularly desirable for elderly patients to be able to keep track of the doses taken, and to have a visual reminder when it is time to have the prescription refilled.

A type of package particularly useful in this situation is one wherein blisters or pockets are formed in thin plastic sheet material, each of the blisters or pockets having a capacity to contain one or more pills or capsules. Such packages are sometimes provided with a chart or labeled cover with indicia to indicate the day for taking the dosage in each compartment. Examples of this type of package are disclosed in U.S. Pat. Nos. 2,012,405; 2,317,860; 3,324,995; 3,397,671; 3,494,322; 3,780,856; 3,835,995 and 3,899,080.

One of the objects of the present invention is to provide a package of the type referred to in the preceding paragraph that can be easily filled and assembled, and in which the pills can be more easily removed from the package for consumption.

In carrying out the foregoing, and other objects, a package according to the present invention includes a cover portion made up of a layer of relatively stiff material such as paperboard or the like with a vapor layer of metal foil or the like laminated to or bonded to one surface thereof. A container portion of flexible synthetic resin material or the like is bonded to the metal foil surface of the cover portion. The container portion is formed with a plurality of blisters or pockets for containing individual doses, usually in the form of pills or the like.

The outer layer of the cover portion has high strength and stiffness relative to the foil layer. A plurality of disc-like punch-out lids are die cut or otherwise formed in the outer layer of the cover portion. Each of the lids overlies one of the pockets or blisters of the container portion. The lids are held in place by the foil layer.

When it is desired to remove a pill from one of the pockets, the pocket is collapsed toward the cover portion to cause the pill contained therein to press against the associated lid and cause it to separate from the cover portion. The strength and stiffness of the lid is sufficiently high with respect to the same properties of the foil layer that the portion of the foil secured to the lid ruptures easily and separates with the lid from the cover portion. The pill is thus pressed out of the package easily when the pocket or blister containing it is collapsed.

In the manufacture and assembly of the package, the cover portion is first made by laminating aluminum foil to one surface of paperboard. The lids are then die cut into the paperboard such that the lids are held in place primarily by the portion of the inner foil layer to which it is bonded. The container portion may be vacuum formed from a thin sheet of synthetic resin such as polyvinyl chloride (PVC). A coating of polyvinyl chloride is applied to the surface of the inner foil layer of the cover portion. When the doses are placed into the blisters or pockets of the container portion, the cover portion is placed over the container portion with the foil layer resting against the container portion. The surfaces of the container portion between the pockets in contact with the PVC coating of the foil are heat sealed together to seal each of the pockets or blisters. The foil layer serves as a vapor barrier to prevent the entry of moisture into each of the blisters or pockets.

The outer, paperboard layer of the cover portion is preferably printed with indicia over one or more of the pockets to indicate the day when each dose is to be taken. If only a single dose is to be taken each day, the numeral indicating the day overlies only one pocket. If two or more doses are to be taken each day, the numeral indicating the day overlies the number of pockets required for a complete daily dosage.

Other objects, advantages and features of the invention will become apparent from the following description, taken in connection with the accompanying drawings.

DESCRIPTION OF THE PREFERRED EMBODIMENTS

Figure 1:
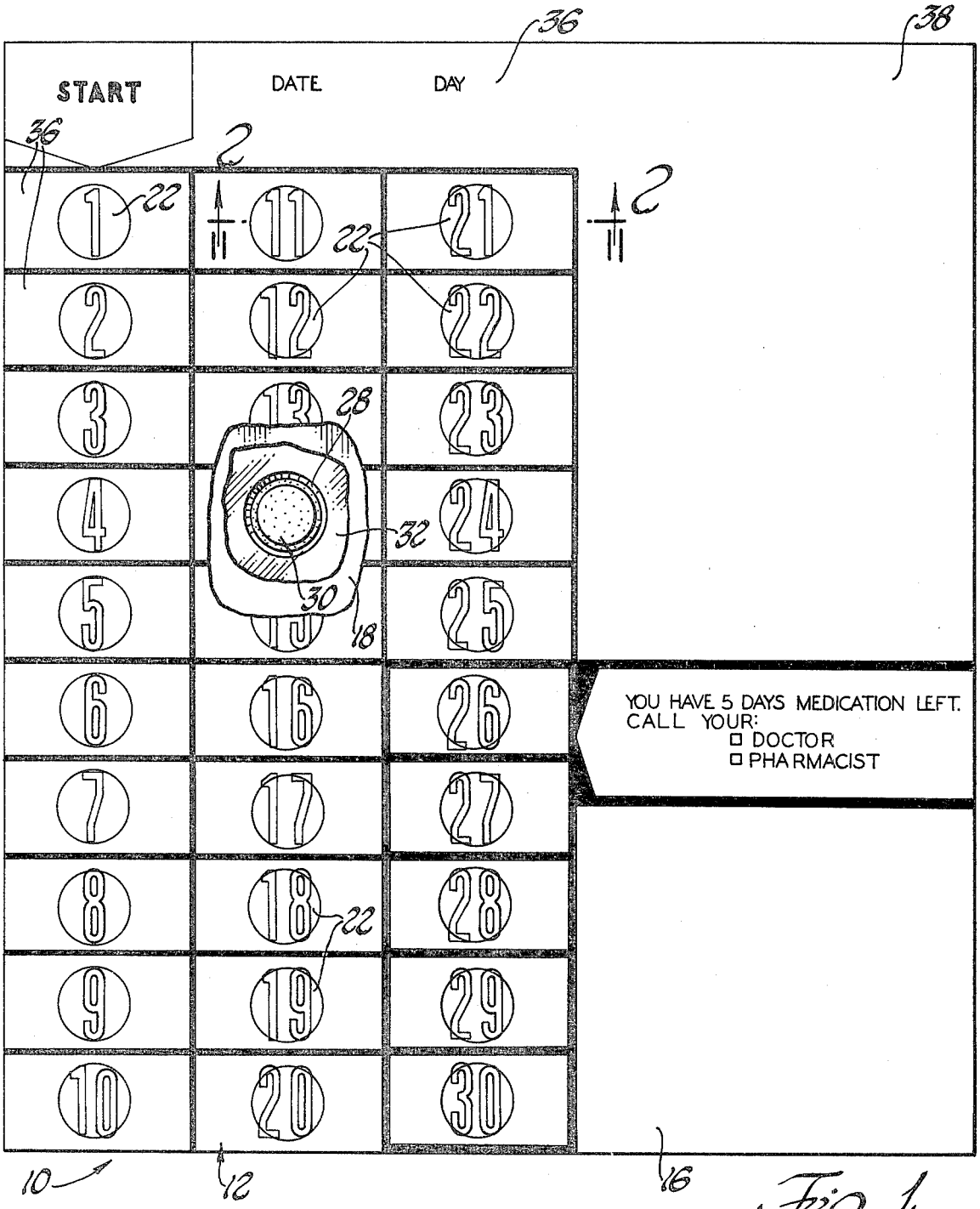
FIG. 1 is a plan view of a package embodying the invention with part of the cover portion being broken away.

Reference numeral 10 collectively designates a package embodying the invention in FIG. 1. The package 10 includes a cover portion designated collectively by reference numeral 12, and a container portion designated collectively by reference numeral 14.

The cover portion 12 includes an outer layer 16 (FIGS. 2, 3 and 4) and an inner layer 18 bonded or laminated to one surface of the layer 16. The outer layer 16 is preferably of paperboard material. The inner layer 18 is preferably of aluminum foil. The surface of the inner layer 18 opposite the paperboard layer 16 is coated with heat sensitive material that is non-tacky except when heated. Preferably, the coating 20 is of polyvinyl chloride. A plurality of spaced, disc-like punch-out lids 22 are formed in the paperboard layer 16 such as by die cutting. The dies cut through the paperboard layer to the surface of the inner foil layer 18, but do not penetrate the foil layer 18. The die cut operation forms openings in layer 16 each having a peripheral edge 24 surrounding a lid 22.

Figure 2:
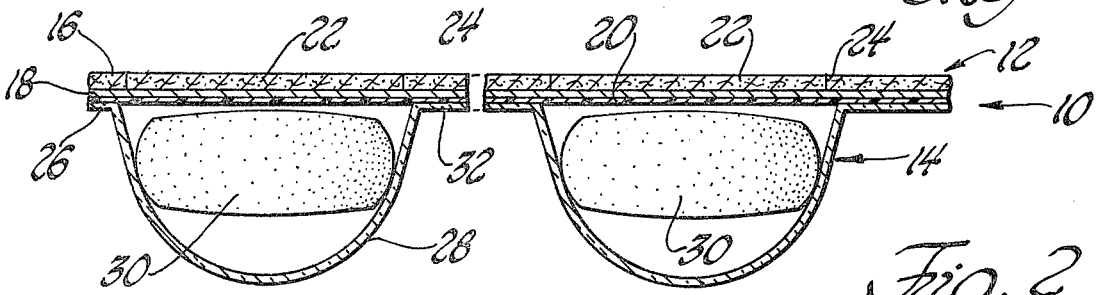
FIG. 2 is an enlarged, sectional detailed view taken on lines 2—2 of FIG. 1.

The container portion 14 is made up of a thin sheet of flexible plastic material 26. Preferably, the sheet material 26 is of polyvinyl chloride (PVC) or similar material. Blisters or pockets 28 are formed in the container portion 14. The pockets may be vacuum formed with the sheet material 26. Each of the pockets 28 is of a size sufficient to contain a single dose of medicine. The medicinal dose is illustrated in FIGS. 1, 2 and 3 in the form of a single pill, tablet or capsule 30.

When a pill 30 is placed in each of the pockets 28, the cover portion 12 is placed over the container portion 14 in a position such that a lid 22 overlies each of the pockets 28. The flat portions 32 of the sheet material 26 of the container portion 14 between the pockets 28 engages the coated surface of the foil layer 18. Heat and pressure are applied at the flat areas 32 to bond the container portion 14 to the inner foil layer 18. The material of the container portion 14 at the flat portions 32 is heat sealed to the portions of the coating 20 in contact with the flat portions 32. The portions of the coating 20 overlying the pockets 28 are not subject to heat, and remain non-tacky throughout the heat sealing operation. Therefore, the pills 30 never come in contact with the coating 20 in a tacky state.

Figure 3:
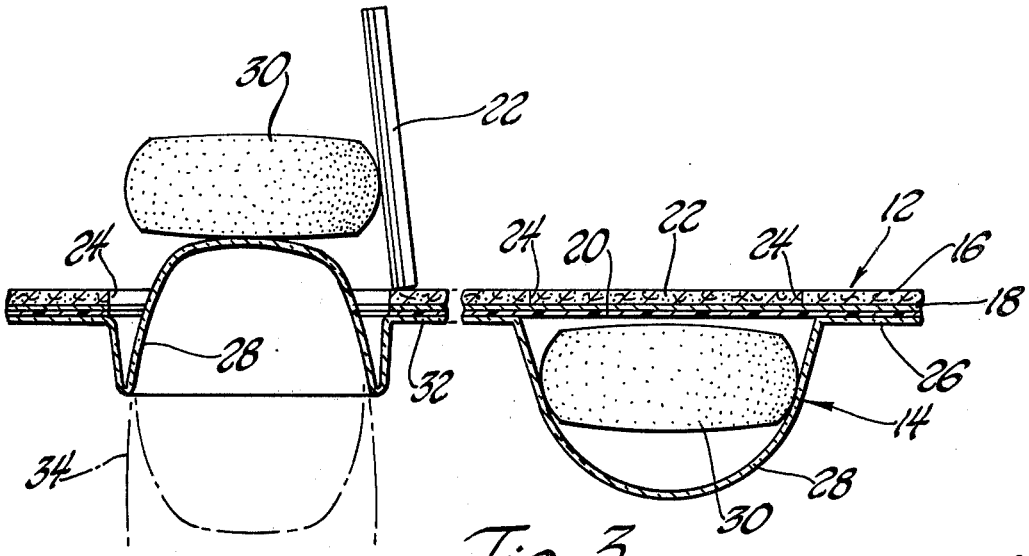
FIG. 3 is a view similar to FIG. 2 illustrating the manner of dispensing a pill from the package.

FIG. 3 illustrates the manner in which a pill 30 is removed from the package. A finger of the user is illustrated in phantom lines in FIG. 3 and designated by reference numeral 34. The pocket 28 which projects outwardly from the cover portion 12 (or downwardly as viewed in the drawing) in its normal condition, is pressed or collapsed toward the cover portion 12. The pill 30 presses against the foil layer 18 causing the portion of the foil layer 18 secured to the lid 22 to rupture. The lid 22 separates from the cover portion and the pill emerges from the package through the opening 24 as the lid 22 is pushed out of the way by the pill. The pills are thus easily removed as needed by simply pushing the pills through the cover portion of the package.

Figure 5:
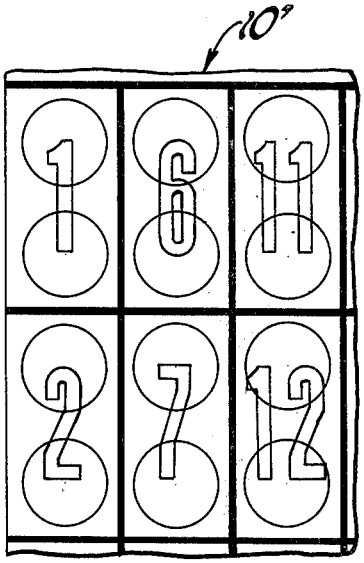
FIGS. 5 and 6 are fragmentary plan views illustrating alternative arrangements of the indicia on the cover portion.
Figure 6:
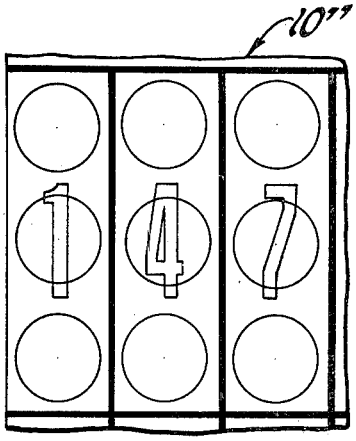

The package illustrated in FIG. 1 contains 30 doses to be taken daily for a period of thirty days. FIG. 5 illustrates a package 10′ in which two doses are to be taken each day. FIG. 6 illustrates a package 10″ wherein three doses are to be taken each day.

In FIG. 1, each daily dose is covered by a printed rectangle 36. The rectangles may be color coded as well as numbered as indicated. For example, the odd numbered rectangles may be of one color, and the even numbers of another color. The rectangles for the last five days, namely, days 26–30 in FIG. 1, may be of the same color, which may be different from the other colors, to indicate to the patient that the patient is nearing the end of the supply of pills contained in the package, and that it is time to order another supply. The cover portion 12 may extend beyond the container portion 14 to provide for appropriate labeling. For example, in FIG. 1, the cover portion 12 has a portion 36 at the upper end as viewed in FIG. 1 containing instructions as to the date and the indication of the starting dose on the column beginning with day one. The cover portion also has a laterally extending portion 38 that may contain other information as desired.

In the FIGS. 5 and 6 embodiments, more than one dose is to be taken each day. For example, in FIG. 5, two doses are to be taken each day. The portions 36 and 38 of the cover portion may contain instructions to take all pills under the number for each day during that day. For example, all pills in block 1 should be taken in the same day. In FIG. 6, three doses are to be taken each day.

Figure 4:
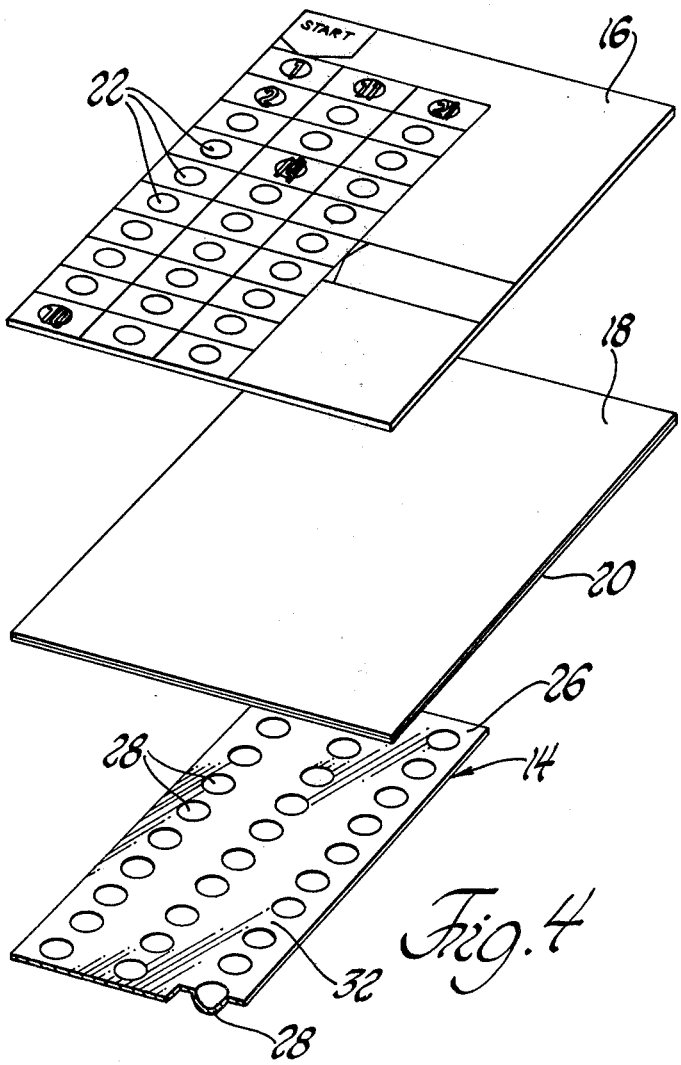
FIG. 4 is an exploded perspective view of the package of FIG. 1.

FIG. 4 illustrates the package of FIG. 1 in an exploded perspective view. The package can be manufactured and assembled inexpensively.

In the manufacture of the cover portion 12, the aluminim foil layer 18 is first laminated or bonded to the paperboard layer 16. The particular size of the cover portion 12 can be cut from a larger sheet after the foil layer 18 has been laminated to the layer 16. The punch-out lids 22 are then die cut into the layer 16, the cutting operation being performed to the full depth of the layer 16, but not penetrating the foil layer 18.

After the die cutting operation, the surface of the inner foil layer 18 is coated with the heat sealable material 20. The thicknesses of the inner layer 18 and coating 20 in FIGS. 2 and 3 are exaggerated for illustrative purposes. The inner layer 18 may be aluminum foil having a thickness, for example, in the order of 0.0005 inches. The coating 20 of heat sealable material may of course be of less thickness than the foil.

As pointed out above, the container portion 14 may be formed by vacuum forming a sheet 26 of flexible plastic material, such as polyvinyl chloride to form the pockets 28.

The indicia and labeling on the surface of the outer layer 16 of the cover portion 12 can be printed on a continuous sheet from which each cover portion is cut.

With a supply of the cover portions 12 and container portions 14 on hand, the pharmacists or other packagers can fill and assemble the packages as needed. The supply of cover portions will include the outer layer 16 with the inner foil layer 18 laminated thereto, the coating 20, and the lids 22 die cut into the outer layer 16. The appropriate indicia and color coding as described in connection with FIGS. 1, 5 and 6 will be printed on the outer layer 16.

In assemblying the package, the pharmacist first fills each of the blisters or pockets 28 with a single dose, which is illustrated in the drawings in the form of a pill 30. The cover portion 12 is then placed over the container portion 14 such that each lid 22 overlies a pocket 28. The flat portions 32 of the container portion 14 are then heat sealed to the foil layer 18 through the coating 20. The pills 30 are thus sealed into the pockets 28 until removed in the manner illustrated in FIG. 3. The aluminum foil layer 18 provides a vapor barrier and protects the pill from contamination and from deterioration due to humidity and moisture.

While a specific form of the invention is illustrated in the accompanying drawings and described in the foregoing specification, it should be understood that the invention is not limited to the exact construction shown. Alterations and variations in the construction and arrangement of parts, all falling within the scope and spirit of the invention, will be apparent to those skilled in the art.

The embodiments of the present invention in which an exclusive property or privilege is claimed are defined as follows:

1. A package for containing a plurality of individual doses of medicine that can be selectively removed one at a time from the package comprising: a laminated cover portion having an outer layer of paperboard bonded to an inner layer of metal foil; a plurality of spaced disc-like lids die cut through said outer layer only and having continuous peripheries that are completely severed from the rest of the outer layer such that said lids are prevented from separating from said cover portion only by their connection with said inner layer; said outer layer having high strength and stiffness relative to said inner layer such that the portion of the inner layer secured to each lid separates with the lid from the cover portion; a coating of heat sealable material applied to the surface of said inner layer opposite said outer layer; a container portion comprising a sheet of flexible synthetic resin material or the like with a plurality of pockets formed therein separated from each other by flat portions; said flat portions being heat sealed to said coating such that said pockets project outwardly from said inner layer of said cover portion; said coating being non-tacky except when heated to a temperature sufficient to heat seal said container portion to said cover portion, said container portion being supported on said cover portion solely by the heat sealed connection of said flat portion to said inner layer of metal foil; the container portion having a side that is completely exposed facing away from the direction toward which the pockets open to the cover portion; one of said lids overlying each of said pockets such that a medicinal dose received in a pocket can be removed from the package by collapsing the pocket and contents thereof against the cover portion to cause the inner layer to rupture at the periphery of the associated lid and the lid to simultaneously separate from the cover portion and permit the medicinal dose to pass through the opening in the cover portion uncovered by said lid.

2. A package as claimed in claim 1 further including indicia printed on said cover portion over each of said pockets for indicating the sequence of removal of the medicine from each pocket.

* * * * *